US010228212B1

(12) United States Patent
Wei

(10) Patent No.: US 10,228,212 B1
(45) Date of Patent: Mar. 12, 2019

(54) TOY GUN AND FAST PIERCING STRUCTURE FOR AIR BOTTLE THEREOF

(71) Applicant: Ho-Sheng Wei, New Taipei (TW)

(72) Inventor: Ho-Sheng Wei, New Taipei (TW)

( * ) Notice: Subject to any disclaimer, the term of this patent is extended or adjusted under 35 U.S.C. 154(b) by 0 days.

(21) Appl. No.: 15/924,195

(22) Filed: Mar. 17, 2018

(51) Int. Cl.
*F41B 11/62* (2013.01)
*F41B 11/721* (2013.01)
*F41B 11/89* (2013.01)

(52) U.S. Cl.
CPC ..... *F41B 11/62* (2013.01); *F41B 11/721* (2013.01); *F41B 11/89* (2013.01)

(58) Field of Classification Search
CPC ..... F41B 11/62; F41B 11/50; F41B 11/51; F41B 11/60; F41B 11/721; F41B 11/89
See application file for complete search history.

(56) References Cited

U.S. PATENT DOCUMENTS 2,940,438 A * 6/1960 Rudolf ..... F41B 11/62 124/51.1
2,955,586 A * 10/1960 Hamrick ..... F41A 21/00 124/27
3,084,833 A * 4/1963 Kline ..... F41B 11/62 124/40
3,207,143 A * 9/1965 Kline ..... F41B 11/62 124/40
3,527,194 A * 9/1970 Desrochers ..... F41B 11/62 124/37
RE27,568 E * 1/1973 Vadas et al. ..... F41B 11/62 124/37
8,079,355 B1 * 12/2011 Chung ..... F41B 11/55 124/71
9,157,694 B1 * 10/2015 Tseng ..... F41B 11/62
9,593,905 B2 * 3/2017 Tseng ..... F41B 11/62
2008/0168974 A1 * 7/2008 Kaminker ..... F41A 9/61 124/74
2014/0338650 A1 * 11/2014 Maeda ..... F41B 11/62 124/74
2017/0299321 A1 * 10/2017 Lort ..... F41B 11/642
2018/0188000 A1 * 7/2018 Yu ..... F41B 11/62

* cited by examiner

*Primary Examiner* — Benjamin P Lee
(74) *Attorney, Agent, or Firm* — Chun-Ming Shih; HDLS IPR Services

(57) ABSTRACT

A toy gun and a fast piercing structure for an air bottle thereof is provided. The air cylinder has a shell body and a receiving space; the shell body forms a first connecting opening and a second connecting opening. The valve seat is disposed at the first connecting opening and has an air channel. The bottle lid is assembled to the second connecting opening and has a throughhole. The piercing pin is disposed in the throughhole. The press set has a base holding the bottle lid, an elastic part, and a plug; the plug is disposed passing through the piercing pin and the base. In this way, the fast piercing structure for an air bottle is provided.

16 Claims, 7 Drawing Sheets

TOY GUN AND FAST PIERCING STRUCTURE FOR AIR BOTTLE THEREOF

BACKGROUND OF THE INVENTION

Field of the Invention

The present invention relates to a toy gun and in particular to a toy gun and a fast piercing structure for an air bottle thereof.

Description of Prior Art

The current toy gun which uses an air bottle as a power source to actuate bullets utilizes the pressure generated by the air steel bottle to provide the necessary force to fire the bullets. Besides, the air steel bottle disposed in the gun body (or the magazine) is rotated into the gun body using a screw seat such that the air steel bottle is pushed and positioned inside the gun body. On the other hand, a piercing pin is disposed at the bottle mouth of the air steel bottle in the gun body. When the air steel bottle is pushed into the gun body, the bottle mouth of the air steel bottle is pierced by the piercing pin and then the compressed air in the air steel bottle is released to provide the power to fire the plastic bullets.

However, the traditional toy gun uses the air steel bottle which is pierced by rotating the screw seat into the gun body, which is time-consuming and inconvenient for the user when every second counts, especially in a revival game. Thus, an improvement in the toy gun is required In view of this, the inventor pays special attention to research with the application of related theory and tries to improve and overcome the above disadvantages regarding the prior art, which becomes the improvement target of the inventor.

SUMMARY OF THE INVENTION

One objective of the present invention is to provide a toy gun and a fast piercing structure for an air bottle thereof, which uses a press set disposed at the bottle lid to elastically press the piercing pin such that the air bottle can be pierced. In this way, a structure for installing the air bottle easily and for piercing the air bottle quickly is obtained.

To achieve the above objective, the present invention provides a fast piercing structure for an air bottle of a toy gun, used to install the air bottle, comprising an air cylinder, a valve seat, a bottle lid, a piercing pin, and a press set. The air cylinder has a shell body and a receiving space for receiving the air bottle. The shell body forms a first connecting opening and a second connecting opening at the opposite ends of the receiving space. The valve seat is disposed at the first connecting opening. The valve seat has an air channel communicating with the receiving space. The bottle lid is assembled to the second connecting opening. The bottle lid has a throughhole communicating with the receiving space. The piercing pin is disposed passing through the throughhole. The piercing pin has an outer end exposed out of the bottle lid and a tip end disposed opposite to the outer end. The press set has a base holding the bottle lid, an elastic part clamped between the bottle lid and the base, and a plug. The plug is disposed passing through the outer end of the piercing pin and the base.

To achieve the above objective, the present invention provides a toy gun comprising a gun body and a fast piercing structure for an air bottle. The fast piercing structure for an air bottle is combined with the gun body to form the toy gun.

Compared with the prior art, the toy gun and the fast piercing structure for an air bottle of the present invention have the valve seat disposed at one end of the air cylinder, the bottle lid disposed at the other end of the air cylinder, and the piercing pin disposed passing in the bottle lid in which the elastic part of the press set can move the piercing pin toward the air bottle. Thus, when the base of the press set is pushed, the elastic part of the press set will be pressed by the base to be elastically compressed. At this time, the base is pressed to move up and moves the piercing pin toward the air bottle to pierce the air bottle. Consequently, the objective of piercing the air bottle quickly is achieved. Also, the convenience and practicality of the present invention are enhanced.

DETAILED DESCRIPTION OF THE INVENTION

The detailed description and technical details of the present invention will be explained below with reference to accompanying drawings. However, the accompanying figures are only for reference and explanation, but not to limit the scope of the present invention.

Figure 1:
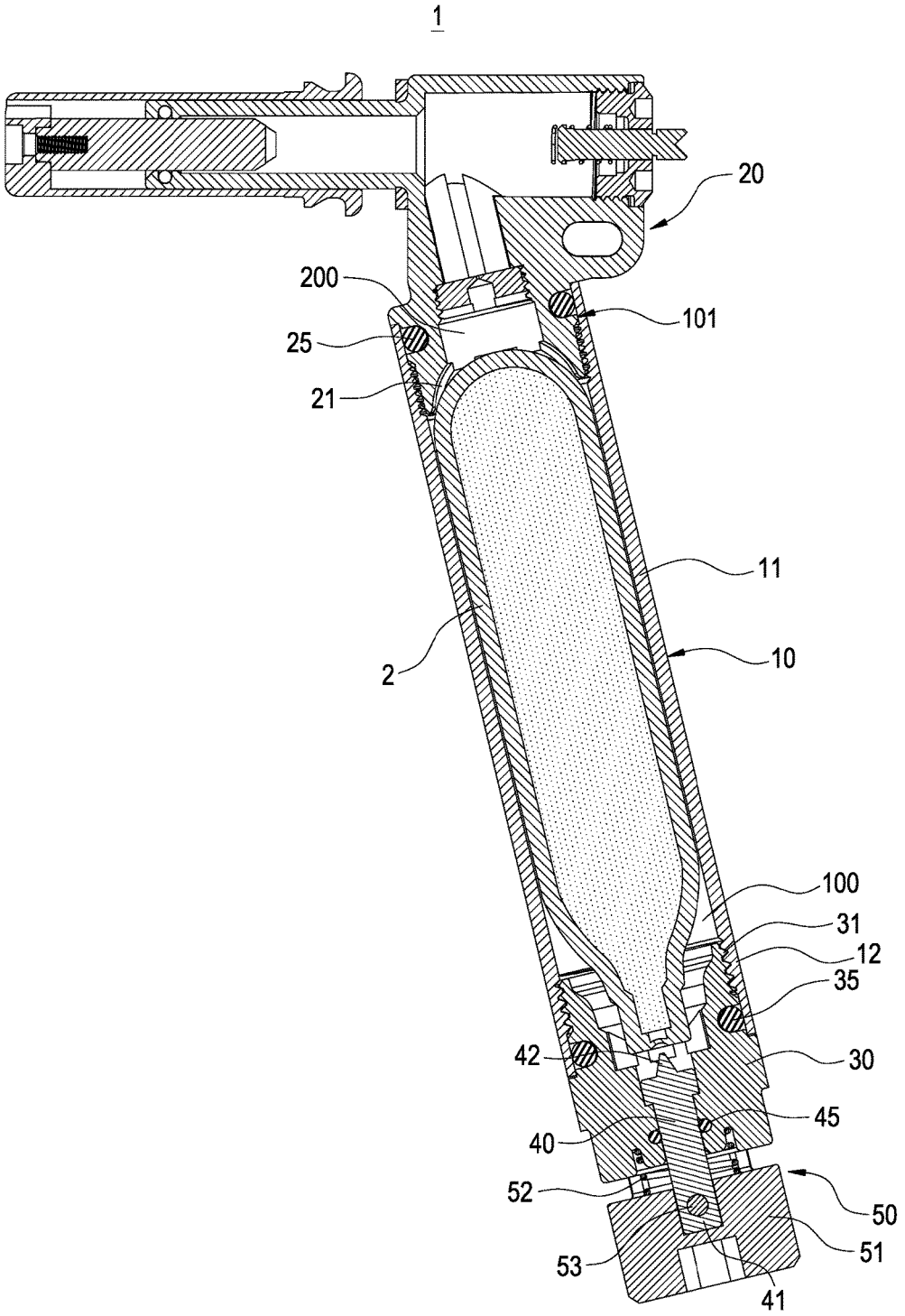
FIG. 1 is a cross-sectional view of the fast piercing structure for an air bottle of a toy gun of the present invention.
Figure 2:
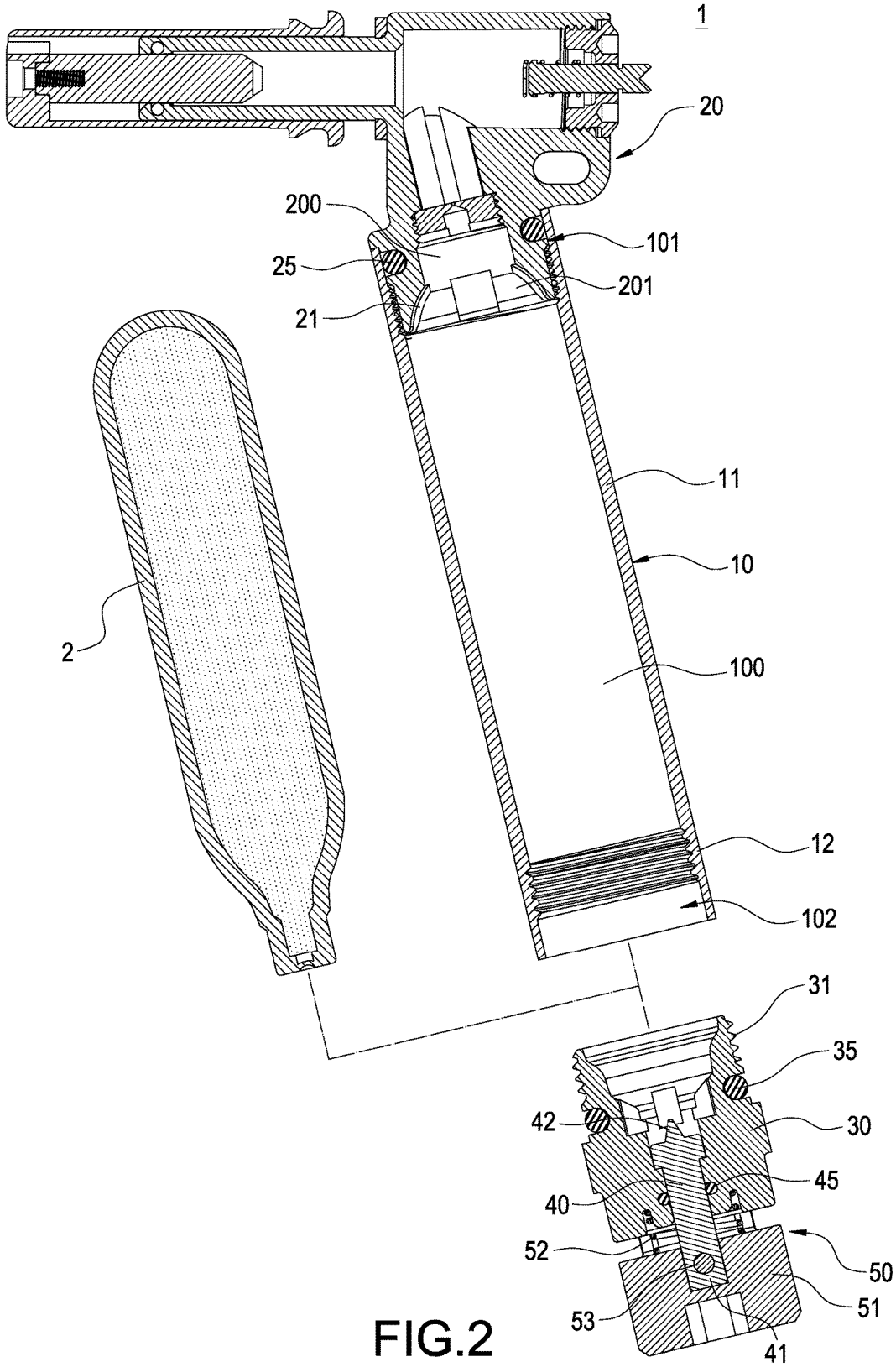
FIG. 2 is an exploded view of the fast piercing structure for an air bottle of a toy gun of the present invention.

Please refer to FIGS. 1 and 2, which are the cross-sectional view and the exploded view of the fast piercing structure for an air bottle of a toy gun of the present invention, respectively. The present invention relates to a fast piercing structure 1 for an air bottle of a toy gun, used to install the air bottle 2. The fast piercing structure 1 for an air bottle comprises an air cylinder 10, a valve seat 20, a bottle lid 30, a piercing pin 40, and a press set 50. The air cylinder 10 receives the air bottle 2. The valve seat 20 is combined with one end of the air cylinder 10; the bottle lid 30 is combined with the other end of the air cylinder 10. The piercing pin 40 is disposed passing through the bottle lid 30 and is elastically pushed by the press set 50 to pierce the air bottle 2 and further to provide the firing power for the toy gun. The fast piercing structure for an air bottle 1 is detailed below.

The air cylinder 10 has a shell body 11 and a receiving space 100 for receiving the air bottle 2. The shell body 11 forms a first connecting opening 101 and a second connecting opening 102 at the opposite ends of the receiving space 100. The air bottle 2 is inserted into the receiving space 100 through the second connecting opening 102. Besides, in the current embodiment, the air cylinder 10 is disposed in the grip of the gun body. In practice, the air cylinder 10 can also be disposed in the magazine, depending on the requirements of the user.

The valve seat 20 is disposed at the first connecting opening 101 and has an air channel 200 communicating with the receiving space 100. Preferably, the valve seat 20 forms a contact space 201 on the side touching the air cylinder 10 corresponding to the outer shape of the air bottle 2.

The valve seat 20 is provided with a plurality of grooves 21 on an inner wall of the contact space 201. The grooves 21 form gaps when one end of the air bottle 2 is pressed against the contact space 201.

Preferably, the fast piercing structure 1 for an air bottle further comprises a first O ring 25 which is disposed between the air cylinder 10 and the valve seat 20. The first O ring 25 is used to keep the air cylinder 10 airtight from the valve seat 20.

The bottle lid 30 is assembled to the second connecting opening 102 and has a throughhole 300 communicating with the receiving space 100.

Preferably, the fast piercing structure 1 for an air bottle further comprises a second O ring 35 which is disposed between the air cylinder 10 and the bottle lid 30. The second O ring 35 is used to keep the air cylinder 10 airtight from the bottle lid 30.

Moreover, the piercing pin 40 is disposed passing through the throughhole 300 of the bottle lid 30. The piercing pin 40 has an outer end 41 exposed out of the bottle lid 30 and a tip end 42 disposed opposite to the outer end 41. The tip end 42 is used to pierce the air bottle 2 received in the receiving space 100.

Preferably, the fast piercing structure 1 for an air bottle further comprises a third O ring 45 which is disposed between the bottle lid 30 and the piercing pin 40. The third O ring 45 is used to keep the air cylinder 10 airtight from the piercing pin 40.

The press set 50 has a base 51 holding the bottle lid 30, an elastic part 52 elastically clamped between the bottle lid 30 and the base 51, and a plug 53. The plug 53 is disposed passing through the outer end 41 of the piercing pin 40 and the base 51.

In the current embodiment, the elastic part 52 is a compression spring. Besides, the air cylinder 10 forms a plurality of first threads 12 on the inner wall of the side connecting the bottle lid 30. The bottle lid 30 forms a plurality of second threads 31 on the side connecting the air cylinder 10. The bottle lid 30 is combined with the air cylinder 10 through the second threads 31 screwing to the first threads 12.

Figure 3:
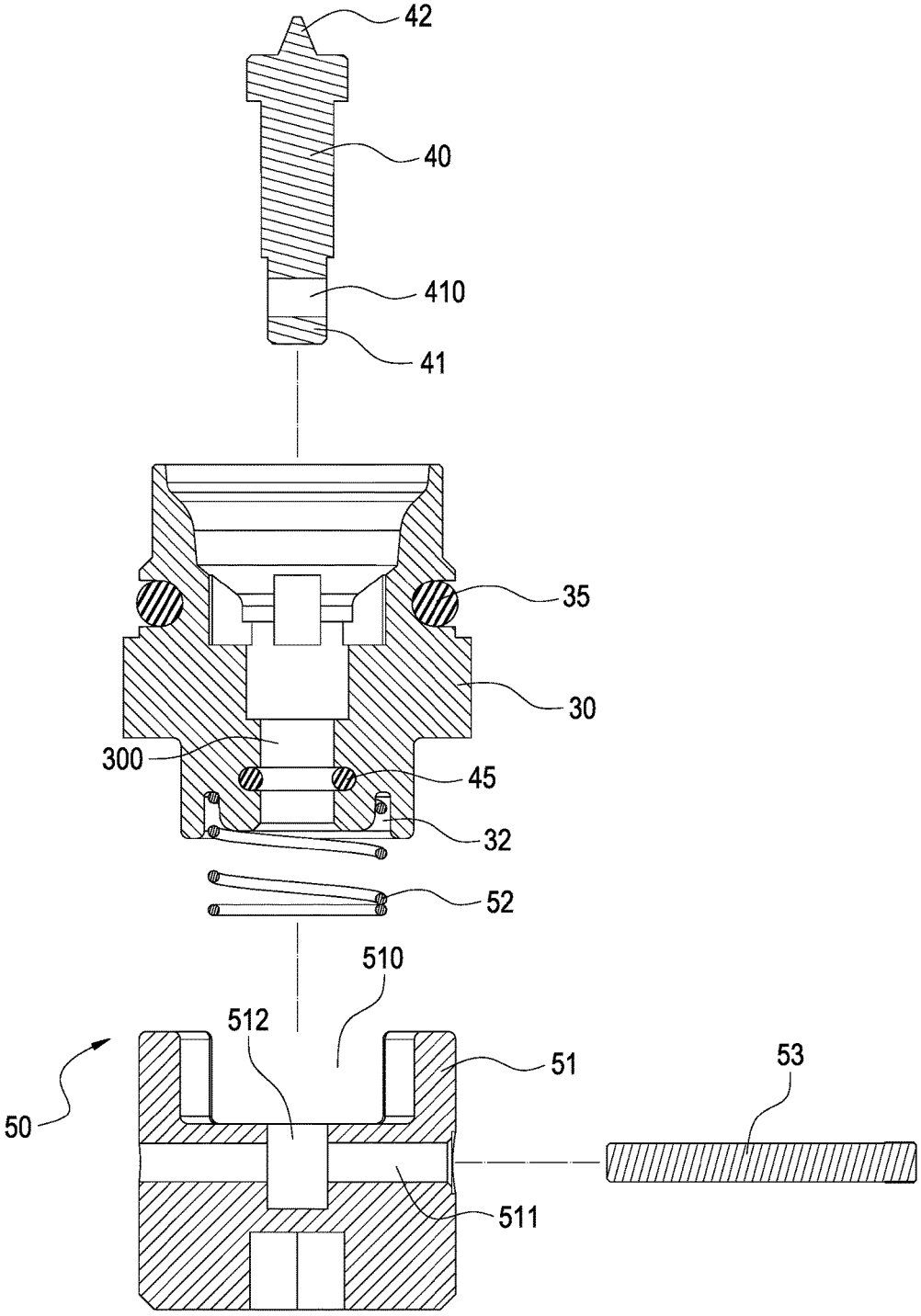
FIG. 3 is an exploded view of the bottle lid and the press set of the toy gun of the present invention.
Figure 4:
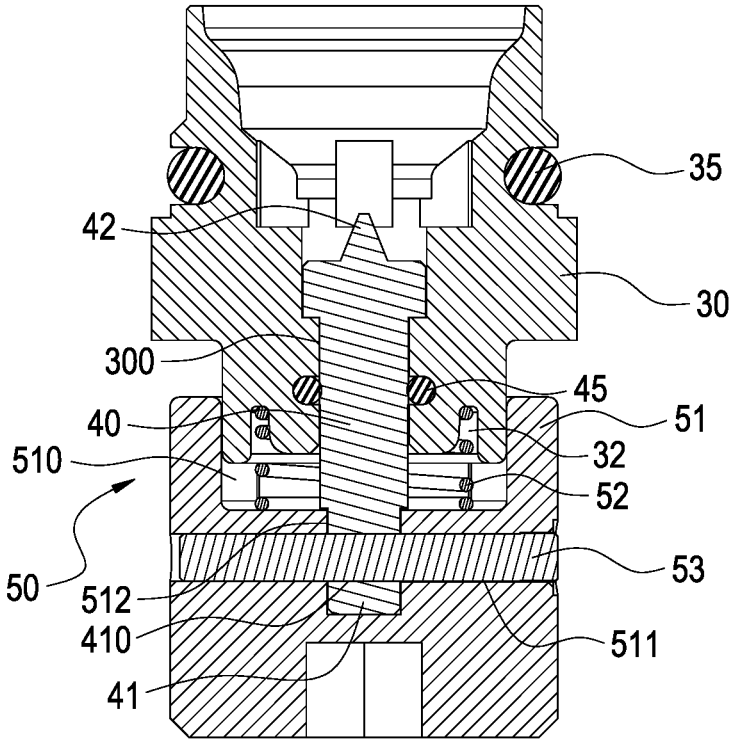
FIG. 4 is an assembled cross-sectional view of the bottle lid and the press set of the toy gun of the present invention.

Please also refer to FIGS. 3 and 4, which are the exploded view and the assembled cross-sectional view of the bottle lid and the press set of the toy gun of the present invention, respectively. As shown in FIGS. 3 and 4, in one embodiment of the present invention, the bottle lid 30 has a circular groove 32 on the side facing the base 51. In addition, the base 51 has a holding space 510 on the side holding the bottle lid 30. One end of the elastic part 52 is disposed in the holding space 510 and the other end of the elastic part 52 is positioned in the circular groove 32.

Further, a passing hole 410 is disposed at the outer end 41 of the piercing pin 40. The base 51 has a plug hole 511 penetrating through the base 51 and being vertical to the axis of the piercing pin 40. Also, wherein the plug 53 is disposed passing through the plug hole 511 and the passing hole 410. Besides, the base 51 is provided with a positioning hole 512 corresponding to the throughhole 300 of the bottle lid 30; the outer end 41 of the piercing pin 40 is positioned in the positioning hole 512. Thus, the press set 50 can elastically push the piercing pin 40 to move the piercing pin 40 toward the air bottle 2 to further pierce the air bottle 2.

Figure 5:
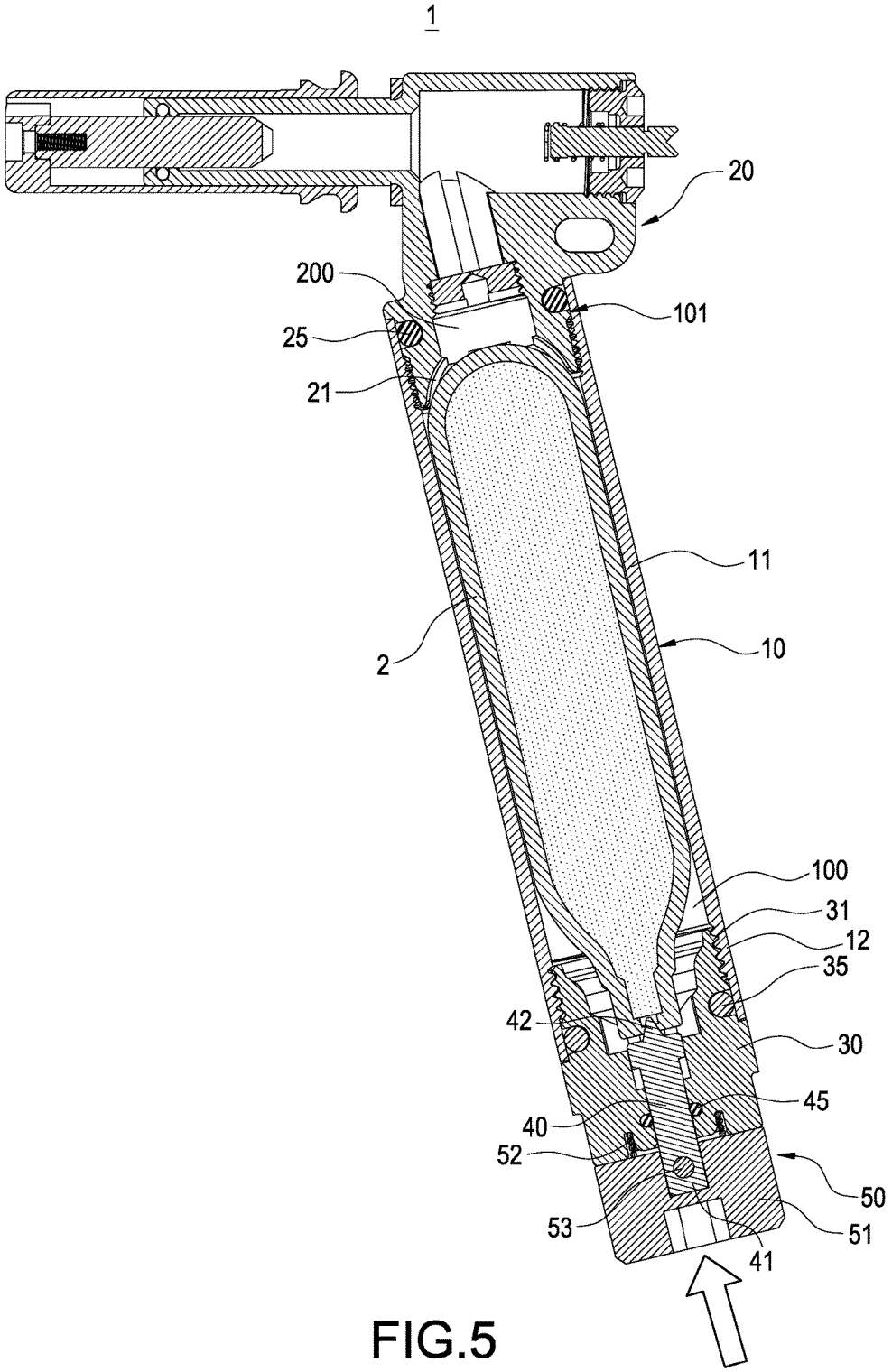
FIGS. 5 and 6 are the schematic views of piercing the air bottle of the bottle lid and the press set of the present invention.
Figure 6:
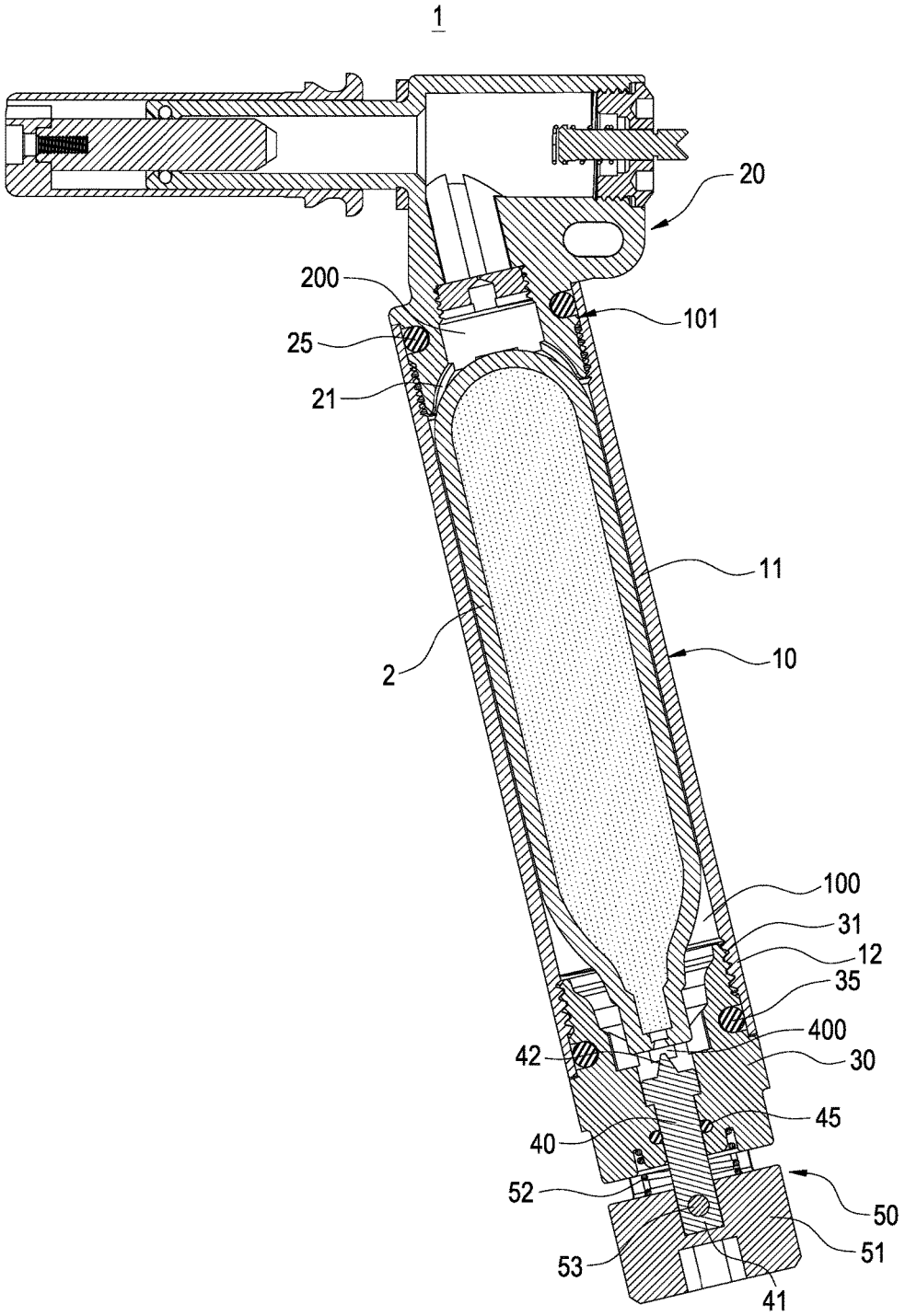

Please refer to FIGS. 5 and 6, which are the schematic views of piercing the air bottle of the bottle lid and the press set of the present invention. In the current embodiment, the air bottle 2 is inserted into the receiving space 100 as mentioned previously and then the bottle lid 30 is turned such that the bottle lid 30 and the press set 50 are combined with the air cylinder 10. Finally, the second connecting opening 102 is sealed.

Please refer to FIG. 5. When the user operates the toy gun of the present invention, he/she has to propel the base 51 of the press set 50. The elastic part 52 is then pushed by the base 51 to be elastically compressed. At this time, the base 51 rises to push the piercing pin 40 toward the air bottle 2 such that the tip end 42 of the piercing pin 40 pierces the air bottle 2.

Please continue to refer to FIG. 6. After the air bottle 2 is pierced, a push is released toward the base 51. At this moment, the base 51 will be replaced by the elastic restoration of the elastic part 52. The base 51 will move the piercing pin 40 back, away from the air bottle 2, and the tip end 42 of the piercing pin 40 will be disconnected from the air bottle 2. Thus, a gap 400 is maintained between the air bottle 2 and the piercing pin 40. The air from the air bottle 2 can stay in the gap 400 first, then enters the throughhole 300, flows through the air bottle 2 and the air cylinder 10, and finally enters the air channel 200 of the valve seat 20 to push the bullets to be fired and to provide the required power for the firing.

Figure 7:
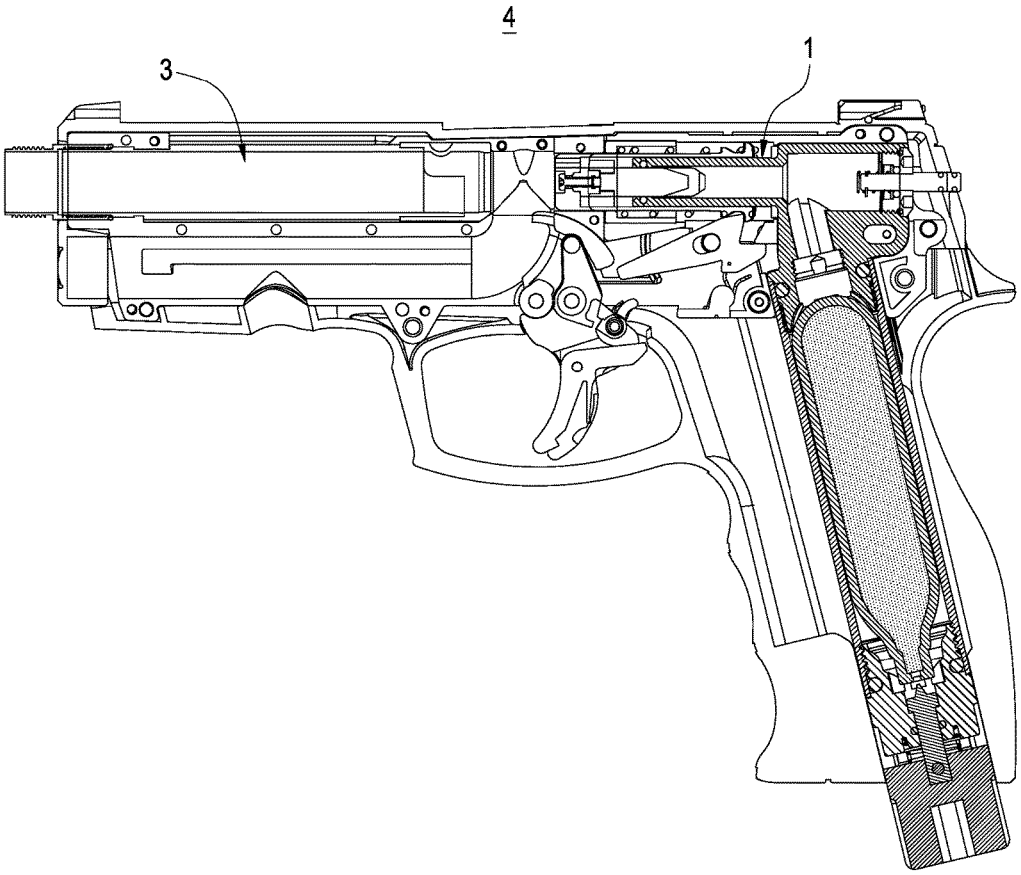
FIG. 7 is a toy gun having the fast piercing structure of an air bottle of the present invention.

Please also refer to FIG. 7, which is the toy gun having the fast piercing structure of an air bottle of the present invention. As shown in FIG. 7, the present invention further provides a toy gun 4 comprising a gun body 3 and the fast piercing structure 1 of an air bottle 2 described above. The fast piercing structure 1 for an air bottle 2 is combined with the gun body 3 to form the toy gun 4.

The embodiments disclosed above are only preferred embodiments of the present invention, but not to limit the scope of the present invention. The scope of the present invention should be embraced by the accompanying claims and includes all the equivalent modifications and not be limited to the previous description.

What is claimed is:

1. A fast piercing structure for an air bottle of a toy gun, used to install the air bottle, comprising:

an air cylinder having a shell body and a receiving space for receiving the air bottle wherein the shell body forms a first connecting opening and a second connecting opening at the opposite ends of the receiving space;

a valve seat disposed at the first connecting opening, wherein the valve seat has an air channel communicating with the receiving space;

a bottle lid assembled to the second connecting opening, wherein the bottle lid has a throughhole communicating with the receiving space;

a piercing pin disposed passing through the throughhole, wherein the piercing pin has an outer end exposed out of the bottle lid and a tip end disposed opposite to the outer end; and a press set having a base holding the bottle lid, an elastic part clamped between the bottle lid and the base, and a plug, wherein the plug is disposed passing through the outer end of the piercing pin and the base, wherein the bottle lid has a circular groove on the side facing the base, wherein the base has a holding space on the side holding the bottle lid, wherein a first end of the elastic part is disposed in the holding space and a second end of the elastic part is positioned in the circular groove, such that the second end of the elastic part is directly against the bottle lid without contacting the piercing pin, and wherein the piercing pin slides relative to the bottle lid when the elastic part extends or is compressed.

2. The fast piercing structure for an air bottle of a toy gun according to claim 1, wherein the valve seat forms a contact space on the side touching the air cylinder corresponding to the outer shape of the air bottle, wherein the valve seat is provided with a plurality of grooves on an inner wall of the contact space, wherein the grooves form gaps when one end of the air bottle is pressed against the contact space.

3. The fast piercing structure for an air bottle of a toy gun according to claim 1, further comprising a first O ring which is disposed between the air cylinder and the valve seat.

4. The fast piercing structure for an air bottle of a toy gun according to claim 1, further comprising a second O ring which is disposed between the air cylinder and the bottle lid.

5. The fast piercing structure for an air bottle of a toy gun according to claim 1, further comprising a third O ring which is disposed between the bottle lid and the piercing pin.

6. The fast piercing structure for an air bottle of a toy gun according to claim 1, wherein the air cylinder forms a plurality of first threads on the inner wall of the side connecting the bottle lid, wherein the bottle lid forms a plurality of second threads on the side connecting the air cylinder, wherein the bottle lid is combined with the air cylinder through the second threads screwing to the first threads.

7. The fast piercing structure for an air bottle of a toy gun according to claim 1, wherein a passing hole is disposed at the outer end of the piercing pin, wherein the base has a plug hole penetrating through the base and being transverse to the axis of the piercing pin, wherein the plug is disposed passing through the plug hole and the passing hole.

8. The fast piercing structure for an air bottle of a toy gun according to claim 1, wherein the base is provided with a positioning hole corresponding to the throughhole of the bottle lid, wherein the outer end of the piercing pin is positioned in the positioning hole.

9. A toy gun, comprising:

a gun body; and a fast piercing structure for an air bottle combined with the gun body to form the toy gun, comprising:

an air cylinder having a shell body and a receiving space for receiving the air bottle, wherein the shell body forms a first connecting opening and a second connecting opening at the opposite ends of the receiving space;

a valve seat disposed at the first connecting opening, wherein the valve seat has an air channel communicating with the receiving space;

a bottle lid assembled to the second connecting opening, wherein the bottle lid has a throughhole communicating with the receiving space;

a piercing pin disposed passing through the throughhole, wherein the piercing pin has an outer end exposed out of the bottle lid and a tip end disposed opposite to the outer end; and a press set having a base holding the bottle lid, an elastic part clamped between the bottle lid and the base, and a plug, wherein the plug is disposed passing through the outer end of the piercing pin and the base, wherein the bottle lid has a circular groove on the side facing the base, wherein the base has a holding space on the side holding the bottle lid, wherein a first end of the elastic part is disposed in the holding space and a second end of the elastic part is positioned in the circular groove, such that the second end of the elastic part is directly against the bottle lid without contacting the piercing pin, and wherein the piercing pin slides relative to the bottle lid when the elastic part extends or is compressed.

10. The toy gun according to claim 9, wherein the valve seat forms a contact space on the side touching the air cylinder corresponding to the outer shape of the air bottle, wherein the valve seat is provided with a plurality of grooves on an inner wall of the contact space, wherein the grooves form gaps when one end of the air bottle is pressed against the contact space.

11. The toy gun according to claim 9, further comprising a first O ring which is disposed between the air cylinder and the valve seat.

12. The toy gun according to claim 9, further comprising a second O ring which is disposed between the air cylinder and the bottle lid.

13. The toy gun according to claim 9, further comprising a third O ring which is disposed between the bottle lid and the piercing pin.

14. The toy gun according to claim 9, wherein the air cylinder forms a plurality of first threads on the inner wall of the side connecting the bottle lid, wherein the bottle lid forms a plurality of second threads on the side connecting the air cylinder, wherein the bottle lid is combined with the air cylinder through the second threads screwing to the first threads.

15. The toy gun according to claim 9, wherein a passing hole is disposed at the outer end of the piercing pin, wherein the base has a plug hole penetrating through the base and being transverse to the axis of the piercing pin, wherein the plug is disposed passing through the plug hole and the passing hole.

16. The toy gun according to claim 9, wherein the base is provided with a positioning hole corresponding to the throughhole of the bottle lid, wherein the outer end of the piercing pin is positioned in the positioning hole.

* * * * *